US006125766A

United States Patent [19]

Flux

[11] Patent Number: 6,125,766

[45] Date of Patent: Oct. 3, 2000

[54] REMOVABLE LOAD TRANSFER DEVICE

[75] Inventor: Peter Robert Flux, Calne, United Kingdom

[73] Assignee: Latchways Limited, Calne, United Kingdom

[21] Appl. No.: 09/108,690

[22] Filed: Jul. 1, 1998

Related U.S. Application Data

[63] Continuation-in-part of application No. 08/737,161, filed as application No. PCT/GB95/01674, Jul. 17, 1995.

[30] Foreign Application Priority Data

Jul. 19, 1994 [GB] United Kingdom ..... 9414571

[51] Int. Cl.[7] ..... B61B 12/12

[52] U.S. Cl. ..... 104/182; 104/115; 104/116

[58] Field of Search ..... 104/112, 113, 104/115, 116, 182; 294/82.11, 82.1, 85; 191/76; 254/402

[56] References Cited

U.S. PATENT DOCUMENTS

| | | | |
|---|---|---|---|
| 364,669 | 6/1887 | Prentice | 104/182 |
| 506,037 | 10/1893 | Forbes | 104/182 |
| 904,119 | 11/1908 | Downs . | |
| 1,122,024 | 12/1914 | O'Connell . | |
| 3,922,972 | 12/1975 | Junes | 104/112 |
| 4,265,179 | 5/1981 | Tupper et al. . | |
| 4,313,236 | 2/1982 | Tupper et al. . | |
| 4,352,330 | 10/1982 | Tupper | 104/182 |
| 4,459,916 | 7/1984 | Tupper | 104/182 |
| 4,462,316 | 7/1984 | Tupper . | |
| 4,470,354 | 9/1984 | Tupper . | |
| 5,056,760 | 10/1991 | Jorgensen . | |
| 5,245,931 | 9/1993 | Cuny . | |

FOREIGN PATENT DOCUMENTS

| | | |
|---|---|---|
| 058810 | 9/1982 | European Pat. Off. . |
| 401087 | 12/1990 | European Pat. Off. . |

*Primary Examiner*—S. Joseph Morano
*Assistant Examiner*—Lars A. Olson
*Attorney, Agent, or Firm*—Klauber & Jackson

[57] ABSTRACT

A load transfer device comprising a pair of spaced-apart rotary members, each having at least one recess formed in its periphery and sharing a common axis of rotation. A slipper member is located between the spaced-apart rotary members and defines therewith a space adapted to receive an elongate support element along which the device travels in use. A positive locking mechanism is also provided for attaching a load to the device in order to prevent accidental release of the load from the device. The spaced-apart rotary members are rotatably mounted in relation to the slipper member and their recesses are adapted to traverse intermediate brackets provided for the elongate support element without user intervention. The limbs of the intermediate brackets are successively received, guided and passed by the recesses automatically. The elongate support element may be introduced into or removed from the space defined by the spaced-apart rotary members to enable the load transfer device to be attached to or removed from the elongate support element.

16 Claims, 8 Drawing Sheets

110
120
127
126
122
124
125
103
101
121
123
190

110
127'
128
125
120
129
190

110
127
121
125
122
190

REMOVABLE LOAD TRANSFER DEVICE

CROSS REFERENCE TO RELATED APPLICATIONS

This application is a continuation-in-part of U.S. patent application Ser. No. 08/737,161 filed Nov. 12, 1996 which in turn is a National Phase application of PCT/GB95/01674 filed Jul. 17, 1995.

FIELD OF THE INVENTION

The present invention relates to a load transfer device which enables a load to be moved along a path defined by an elongate support element, such as a safety line or cable, and past intermediate brackets or attachment points for the elongate support element without fouling. In particular, the invention relates to a load transfer device of the above type which is adapted for easy attachment to and detachment from the elongate support element.

Such a device has numerous applications, for example in building, mining and civil engineering for transferring loads along an overhead guide cable. Similar arrangements may be used in transferring goods and/or personnel from ship to shore and vice versa at quayside locations.

BACKGROUND OF THE INVENTION

Some known load transfer devices suffer from the drawback that they are incapable of negotiating the intermediate brackets along the elongate support element. One solution to this problem is to provide special brackets which can be "opened" to allow the supported load to pass. The weakness of this approach is that the elongate support element temporarily lacks support at the very point where the installer thought it necessary and at the precise moment when it is most needed. Another likely problem is that the brackets may not be accessible to the system user.

An alternative solution is to employ special entry/exit fittings or access points along the elongate support element so that the load transfer device can be attached and removed. The drawback of this proposal is that the access points are not always conveniently situated in relation to the exact location at which attachment or removal is desired. Improved load transfer devices have been developed which are capable of automatically traversing intermediate brackets for the elongate support element without user intervention. Such devices typically comprise a pair of rotatable wheels having a series of recesses at spaced locations around their peripheries, the adjacent recesses being separated by a radially projecting part of the wheel. A cooperating slipper part is mounted on the wheels by means of formations which inter-engage with complementary formations on the radially projecting wheel parts. A space between the slipper part and the wheels is dimensioned to receive elongate support element such as a cable or a rigid elongate element.

In use, the device is able to negotiate intermediate brackets for the elongate support element without user intervention by accommodating the bracket legs in a pair of aligned recesses carried by the respective wheels. Rotation of the wheels relative to the slipper part causes the intermediate bracket to pass behind the slipper part, in the aligned recesses of the rotating wheels.

Unfortunately, such devices still fail to address the problem of ease of attachment to or removal from the elongate support element.

A removable load transfer device is known from U.S. Pat. No. 5,245,931. This device has a specially-configured oblique cut-out portion formed in each of its rotating wheels to facilitate removal from and attachment to a safety line or cable. In order to effect such removal or attachment, the wheels must be aligned so that the safety line or cable can be accommodated in the cut-outs at an oblique orientation relative to the axis of rotation of the wheels. This enables the safety line or cable to be passed behind the slipper part. One disadvantage of this device is that it requires precise alignment of a number of parts and is therefore awkward to use. Also, the necessity to orient the device obliquely in relation to the safety line or cable means that considerable clearance is required around the device in order to remove or attach it.

Another disadvantage of the prior art device referred to above is that it does not fail safe. Although locking means are optionally provided to prevent inadvertent alignment of the cut-outs leading to unwanted disengagement from the safety line or cable, there is nothing to prohibit deactivation of the locking means. Nor is there anything to ensure that the locking means are actuated in the first instance. Thus, it is possible for a user to install the device on the safety line or cable without positively actuating the locking means.

OBJECTS OF THE INVENTION

It is therefore an object of the present invention to provide a load transfer device which is capable of negotiating intermediate brackets for the elongate support element without user input and which also allows attachment to and removal from the elongate support element at any point without the need for special entry/exit fittings on the load transfer system.

It is a further object of the invention to provide a load transfer device which is inherently fail safe in its operation and which is incapable of being deployed for its intended purpose if operational safety is compromised.

SUMMARY OF THE INVENTION

In a first aspect, the invention is a load transfer device comprising:

(a) first and second spaced-apart rotary members sharing a common axis of rotation, each of said spaced-apart rotary members having at least one recess formed in its periphery;

(b) a slipper member extending between the spaced-apart members and defining therewith a space adapted to receive an elongate support element in an orientation substantially perpendicular to said common axis of rotation, along which the device travels in use, said slipper member being positively engaged with the spaced-apart rotary members;

(c) first and second spaced-apart body members, each of said first and second spaced-apart body members having a respective one of said first and second spaced-apart rotary members rotatably mounted thereon;

(d) a passage provided between the first and second spaced-apart body members, said passage being narrower than the width of said elongate support element; and (e) load attachment means for attaching a load to the device, said load attachment means comprising a connecting eye provided on a portion of each of said first and second spaced-apart body members, the respective connecting eyes being adapted to be in alignment during operation of the device, such that said spaced-apart rotary members are rotatably mounted in relation to the slipper member and said recesses are adapted to traverse support means used to support said elongate support element without user intervention by rotation of the spaced-apart rotary members relative to the slipper member whereby elements of said support means are successively received, guided and passed by the recesses automatically;

characterized in that said first and second spaced-apart body members are transversely moveable in relation to each other such that, when they are moved out of alignment with each other, access means is formed permitting said elongate support element to be introduced into or removed from said space by means of said passage to enable the device to be attached to or detached from the elongate element.

As indicated above, the access means is implemented by relative transverse movement between the body members. For example, the spaced-apart body members may be slidable relative to one another. The sliding motion may be along a straight line, or may be on an arcuate path. In an especially preferred arrangement, the spaced-apart body members on which the spaced-apart rotary members are mounted are arranged to pivot relative to each other in a plane substantially parallel to the plane of rotation of the spaced-apart rotary members. At least one of the spaced-apart body members has a longitudinal groove on its surface facing the other part. This groove is dimensioned to receive the elongate support element but is exposed only when the spaced-apart body members are pivoted out of register. When the spaced-apart body members are aligned, the groove is obscured and access to it is prevented because the passage between them is narrower than the width of the elongate support element.

In a second aspect, the invention is a load transfer device comprising:

(a) first and second spaced-apart rotary members sharing a common axis of rotation, each of said spaced-apart rotary members having at least one recess formed in its periphery;

(b) a slipper member extending between the spaced-apart rotary members and defining therewith a space adapted to receive an elongate support element in an orientation substantially perpendicular to said common axis of rotation, along which the device travels in use, said slipper member being positively engaged with the spaced-apart rotary members;

(c) first and second chassis members, each of said first and second chassis members having a respective one of said first and second spaced-apart rotary members rotatably mounted thereon, (d) load attachment means for attaching a load to the device, said load attachment means comprising a connecting eye provided on a portion of each of said first and second chassis members, the respective connecting eyes being adapted to be in alignment during operation of the device;

(e) means for separating said first and second chassis members thereby to form a passage between one of said first and second spaced-apart rotary members and said slipper member, said passage permitting said elongate support element to be introduced into or removed from said space to enable the device to be attached to or detached from the elongate element; and (f) means for preventing separation of said first and second chassis members when a load is attached, such that said spaced-apart rotary members are rotatably mounted in relation to the slipper member and said recesses are adapted to traverse support means used to support said elongate support element without user intervention by rotation of the spaced-apart rotary members relative to the slipper member whereby elements of said support means are successively received, guided and passed by the recesses automatically.

When the chassis members are separated, the access means is open but, when the chassis is assembled, the access means is closed.

In a third aspect, the invention is a load transfer device comprising:

(a) first and second spaced-apart rotary members sharing a common axis of rotation, each of said spaced-apart rotary members having at least one recess formed in its periphery;

(b) a slipper member extending between the spaced-apart rotary members and defining therewith a space adapted to receive an elongate support element in an orientation substantially perpendicular to said common axis of rotation, along which the device travels in use, said slipper member being positively engaged with the spaced-apart rotary members in a manner which allows the spaced-apart rotary members to be pried apart a sufficient distance to permit insertion or withdrawal of the elongate support element, said slipper member further being combined with a resilient keep member which exerts a biasing force opposing the action of prying apart of the spaced-apart rotary members; and (c) load attachment means for attaching a load to the device, such that the spaced-apart rotary members are rotatably mounted in relation to the slipper member and said recesses are adapted to traverse support means used to support said elongate support element without user intervention by rotation of the spaced-apart rotary members relative to the slipper member such that elements of said support means are successively received, guided and passed by the recesses automatically;

characterized in that access means are provided between the spaced-apart rotary members to enable said elongate support element to be introduced into or removed from said space in an orientation substantially perpendicular to the common axis of rotation of the spaced-apart rotary members so as to allow the device to be attached to or detached from the elongate support element.

In such an arrangement, the relaxed state of the device is one in which the spaced-apart rotary members share a common axis of rotation and define with the slipper member a space of suitable dimensions to accommodate the elongate support element with sufficient clearance to permit sliding motion. As indicated above, the slipper member is combined with a resilient keep member which exerts a biasing force opposing the action of prying apart. In this way, the device is maintained in a fail-safe condition in which unintentional removal from or attachment to the elongate support element is prevented.

Devices constructed in accordance with the invention are especially advantageous because they provide, in a single unit, the capability to traverse automatically the intermediate support brackets provided along a guide system, and ease of attachment to or detachment from the elongate support element at any point throughout its length.

Also, because they are designed for attachment to or detachment from the elongate support element in an orientation substantially perpendicular to the common axis of rotation of the spaced-apart members, they do not require a large volume of space around the elongate support element for manipulation.

The feature of positive engagement between the spaced-apart rotary members and the slipper member allows various forms of the invention to be designed in which insertion or removal of the elongate support element involves passage of the elongate support element across the common axis of rotation of the spaced-apart rotary members. By virtue of the fact that the spaced-apart rotary members are positively engaged with the slipper member, the axle means for rotatably mounting the spaced-apart rotary members may be reduced in size to minimal stub axles between which a support element-receiving passageway is defined. In the first embodiment described above, this passageway is equipped with gate means (access means) to prevent accidental insertion and/or removal of the elongate support element.

Conveniently, the access means form part of the load attachment means. Most preferably, the arrangement is such that engagement of a load with the load attachment means is itself effective to lock the device against accidental removal from the elongate support element.

Most advantageously, the device incorporates releasable means for maintaining the spaced-apart rotary members and the slipper member in a closed condition in which introduction or removal of the elongate support element is prevented. This feature means that a conscious decision must be taken on the part of the user to open the device.

Preferably, the releasable means includes a positive locking mechanism which retains the parts in the closed condition against accidental release. The locking mechanism may be biased to its non-release position for added safety As indicated above, the presence of a load engaged with the load attachment means may serve to prevent accidental release.

The spaced-apart rotary members may be provided with a formation on the respective surfaces thereof facing the slipper member, for cooperation with a complementary formation on the slipper member. This helps to maintain the relatively rotatable parts in their respective operating relationships. For example, the spaced-apart rotary members may each be provided with a surface groove which cooperates with complementary projections on the slipper member. Alternatively, the grooves may be provided on the slipper member and the projections on the spaced-apart rotary members.

In one form of the invention, one of the grooves may be formed with an undercut profile so that it surrounds the head portion of its cooperating projection or projections and thereby effects a positive engagement between the cooperating parts. Such an arrangement would allow one of the spaced-apart rotary members to be positively engaged with the slipper member so that the two are movable as a unitary element in relation to the other spaced-apart rotary member.

Alternatively, both grooves are formed with an undercut profile, enabling each of the spaced-apart rotary members to be positively engaged with the slipper member. This type of arrangement is particularly suited to the embodiment discussed above in which the components are pried apart against biasing pressure to create a gap for the elongate support element.

The spaced-apart rotary members may be in the form of wheels having a plurality of petals projecting radially from their hubs. The petals then define, between adjacent pairs thereof, recesses of the type required for automatic traversing of the elongate support element intermediate brackets. The provision of a plurality of recesses may be helpful in aligning the device with respective limbs of successive elongate support element brackets during a lengthy traverse.

One or more rollers may be incorporated in the slipper member to ease passage of the device along the elongate support element in normal use.

The important feature of all manifestations of the device is the ability to create a passage which allows the elongate support element to be introduced into or removed from the space defined between the spaced-apart rotary members and the slipper member.

BRIEF DESCRIPTION OF THE DRAWINGS

The invention will now be described by way of example only with reference to the drawings, in which:

Referring now to FIGS. 1 and 2, an especially preferred embodiment of a removable load transfer device constructed in accordance with the invention is shown. The device comprises a pair of spaced-apart rotary members (only one shown in FIG. 1) in the form of so-called starwheels 101, 102 each having a respective cover member 103, 104. The cover members serve to protect the petals of the starwheels from damage in use of the device and may be fashioned to assist in aligning the device with intermediate support brackets as the device is traversed along an elongate support element such as a wire or cable.

Figure 2:
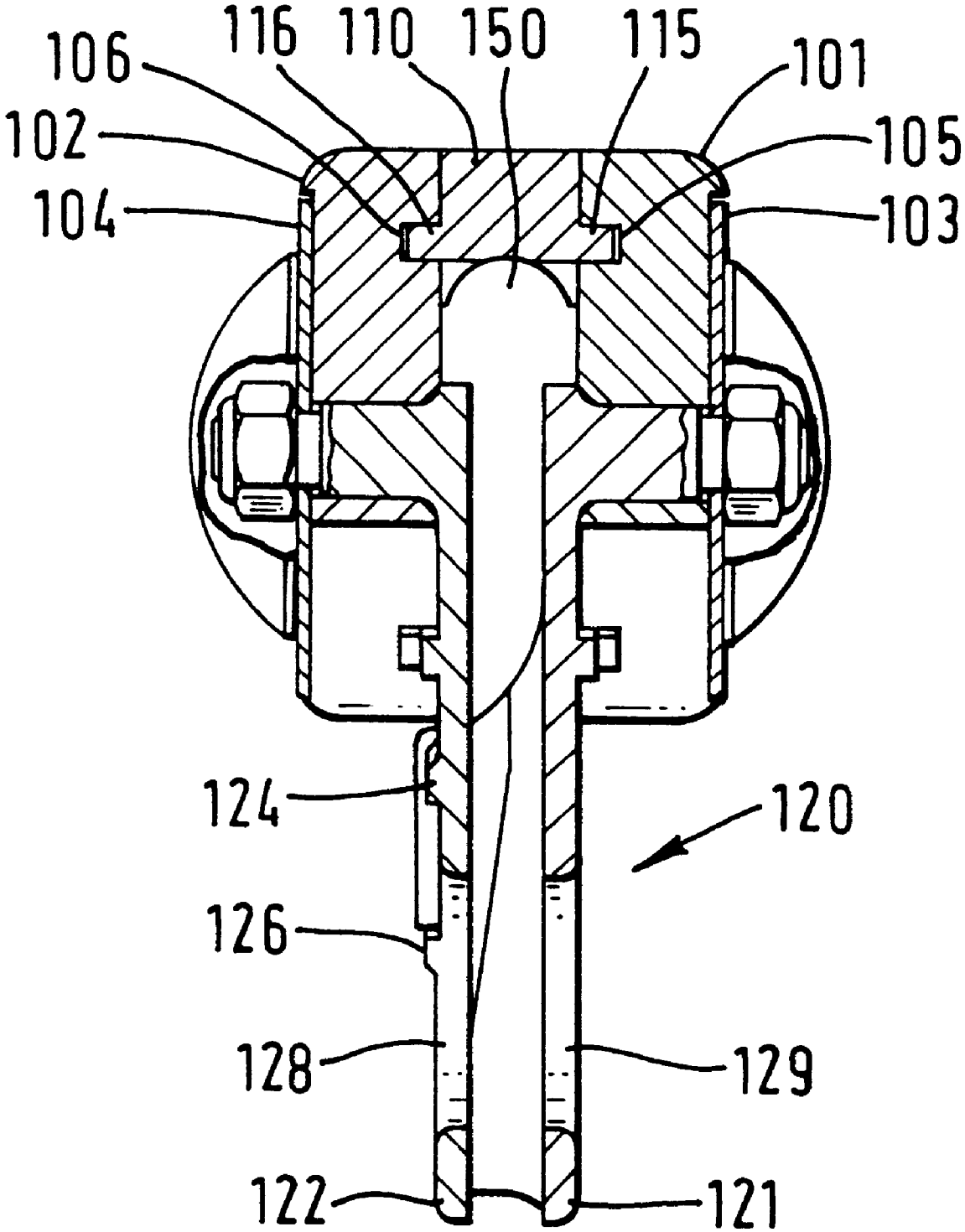
FIG. 2 is a front sectional view of the device shown in FIG. 1.

A slipper member 110 is located between the starwheels 101, 102. Slipper member 110 is provided with a pair of side projections 115, 116 which are engaged in complementary grooves 105, 106 formed in the respective starwheels 101, 102. In the closed condition as shown in FIG. 2, the combination of starwheels 101, 102 and slipper member 110 define a space 150 in which an elongate support element (not shown) is receivable in use.

A chassis 120 is comprised of two relatively pivotable members 121, 122. Member 121 is formed on its surface facing member 122 with a longitudinal groove 123 which is dimensioned to accommodate an elongate support element 190. Member 121 is further provided with stops 125, 127 for limiting the extent of pivotal movement relative to member 122. Member 122 is provided on its outer surface with arcuate guides 124, 126 which interact with stops 125, 127 to enhance smooth operation of the device.

Insertion of the elongate support element 190 into the groove 123 is only possible when the respective members 121, 122 are pivoted out of alignment to expose the groove fully. When the groove is partly or wholly obscured, the gap between members 121, 122 is too small to allow the elongate support element 190 to be inserted or removed. However, in this condition, the members 121, 122 are still capable of relative pivotal movement provided that the elongate support element 190 is located in the groove 123.

Figures 1A, 1B, 1C:
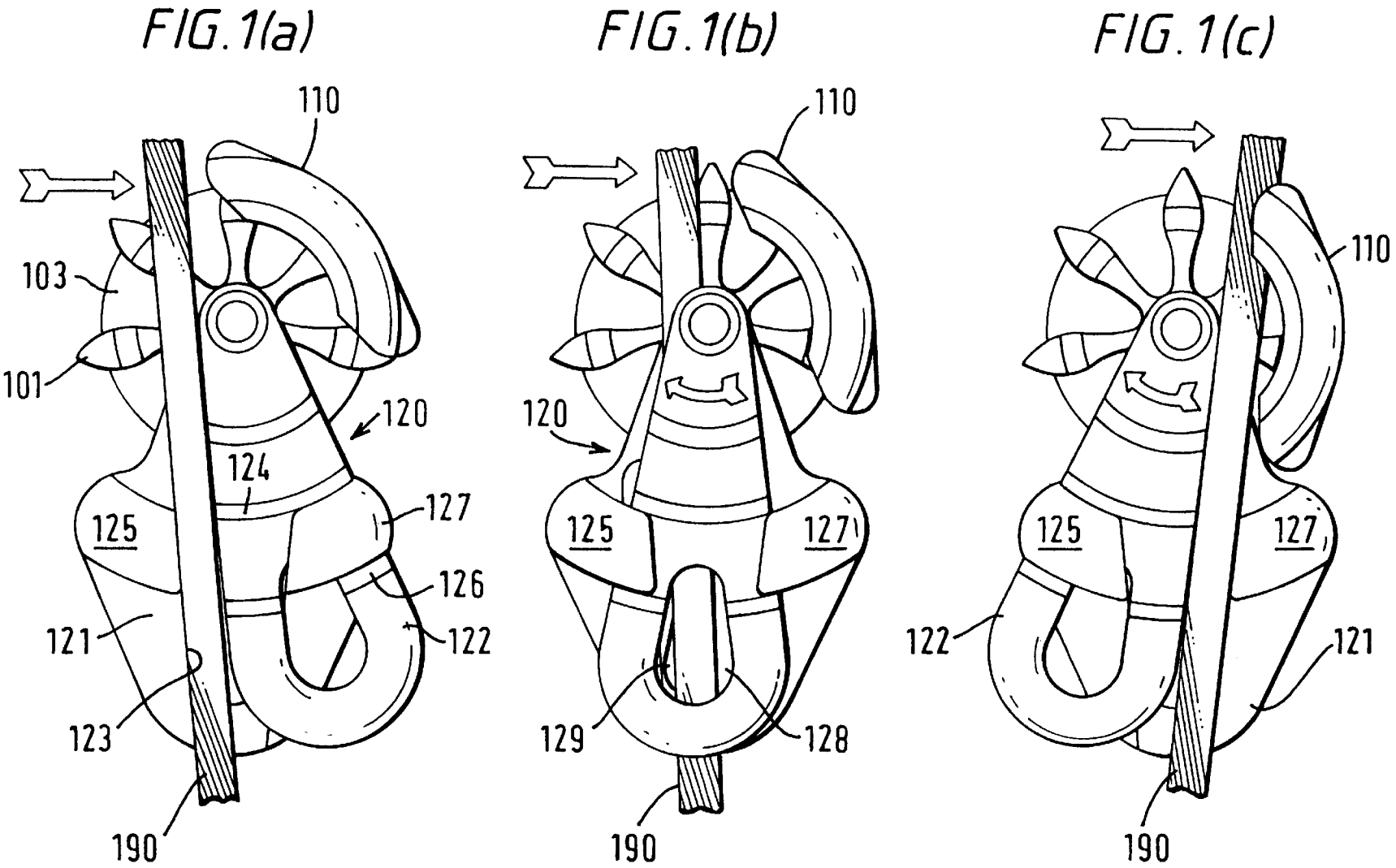
FIG. 1 is a side view of an especially preferred form of the invention, with one of the spaced-apart rotary members and its cover omitted for clarity, showing attachment of the device to a cable.

In FIG. 1(*a*), the first step is shown for attachment of the device to an elongate support element 190. Members 121, 122 are pivoted out of alignment to expose groove 123 and then the device is offered to elongate support element 190 such that it is accommodated in the groove 123.

Then the members 121, 122 are pivoted towards a neutral position in which they overlie each other. This condition is shown in FIG. 1(*b*).

Continuation of this pivotal movement to the condition shown in FIG. 1(*c*) exposes the groove 123 at the other side of member 122. In this condition, the elongate support element 190 may be removed from the groove. Re-alignment of the members 121, 122 prevents access to the groove and the elongate support element 190 is held captive in the space 150 defined by starwheels 101, 102 and slipper member 110.

Removal of the device from the elongate support element 190 is effected by execution of the above steps in the reverse order.

It will be noted that each of the members 121, 122 is formed with a respective connecting eye 129, 128. These are adapted to receive a connector such as a karabiner hook on which a load is supported in use of the device. The arrangement is such that the connecting eyes are aligned when the device is in its neutral condition, so that engagement by a karabiner hook or similar connector prevents relative pivotal movement of the members 121, 122. Thus, it is not. possible to attach the device to, or remove it from, an elongate support element 190 when a load is attached through the connecting eyes 129, 128. Therefore, the device is inherently fail-safe.

Figure 3:
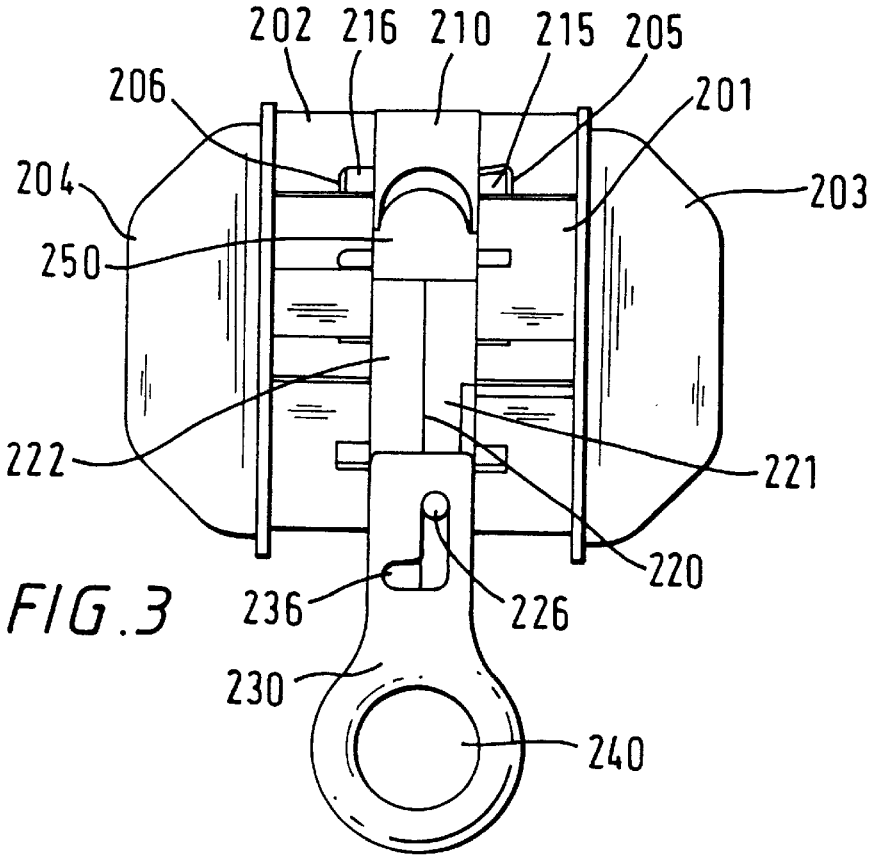
FIG. 3 is an end view of one embodiment of a device constructed in accordance with the invention, in the closed condition.

Referring now to FIG. 3, a first embodiment of a load attachment device constructed in accordance with the present invention is shown. The device comprises a pair of spaced-apart rotary members in the form of so-called starwheels 201, 202 each having a respective cover member 203, 204. The cover members serve to protect the petals of the starwheels from damage in use of-the device and may be fashioned to assist in aligning the device with elongate support element intermediate brackets as the device is traversed across such features.

A slipper member 210 is located between the starwheels 201, 202. Slipper member 210 is provided with a pair of side projections 215, 216 which are engaged in complementary grooves 205, 206 formed in the respective starwheels 201, 202. Side projection 215 is formed with an undercut profile and groove 205 is formed with a re-entrant profile, enabling the slipper member 210 and the starwheel 201 to be positively engaged to each other whilst allowing relative rotation therebetween. By contrast, side projection 216 and groove 206 have plain profiles which permit disengagement of the slipper member 210 and the starwheel 202 from each other. In the closed condition as shown, the combination of starwheels 201, 202 and slipper member 210 define a space 250 in which an elongate support element (not shown) is receivable in use.

A chassis 220 is comprised of two separable portions 221, 222. This is best seen with reference to FIG. 5, in which the slipper member 210, starwheels 201, 202 and their respective covers 203, 204 have been omitted for clarity. A control catch 230 overlies the separable portions 221, 222 and keeps them together when the apparatus is in the closed condition. A lock pin 226 formed on the separable chassis portion 221 is received in L-shaped slot 236 formed in the control catch 230. Disengagement of the separable chassis portions 221, 222 is constrained by the interaction of the lock pin 226 with the L-shaped slot 236, so that the motion of disengagement follows a pre-determined path.

Figure 7:
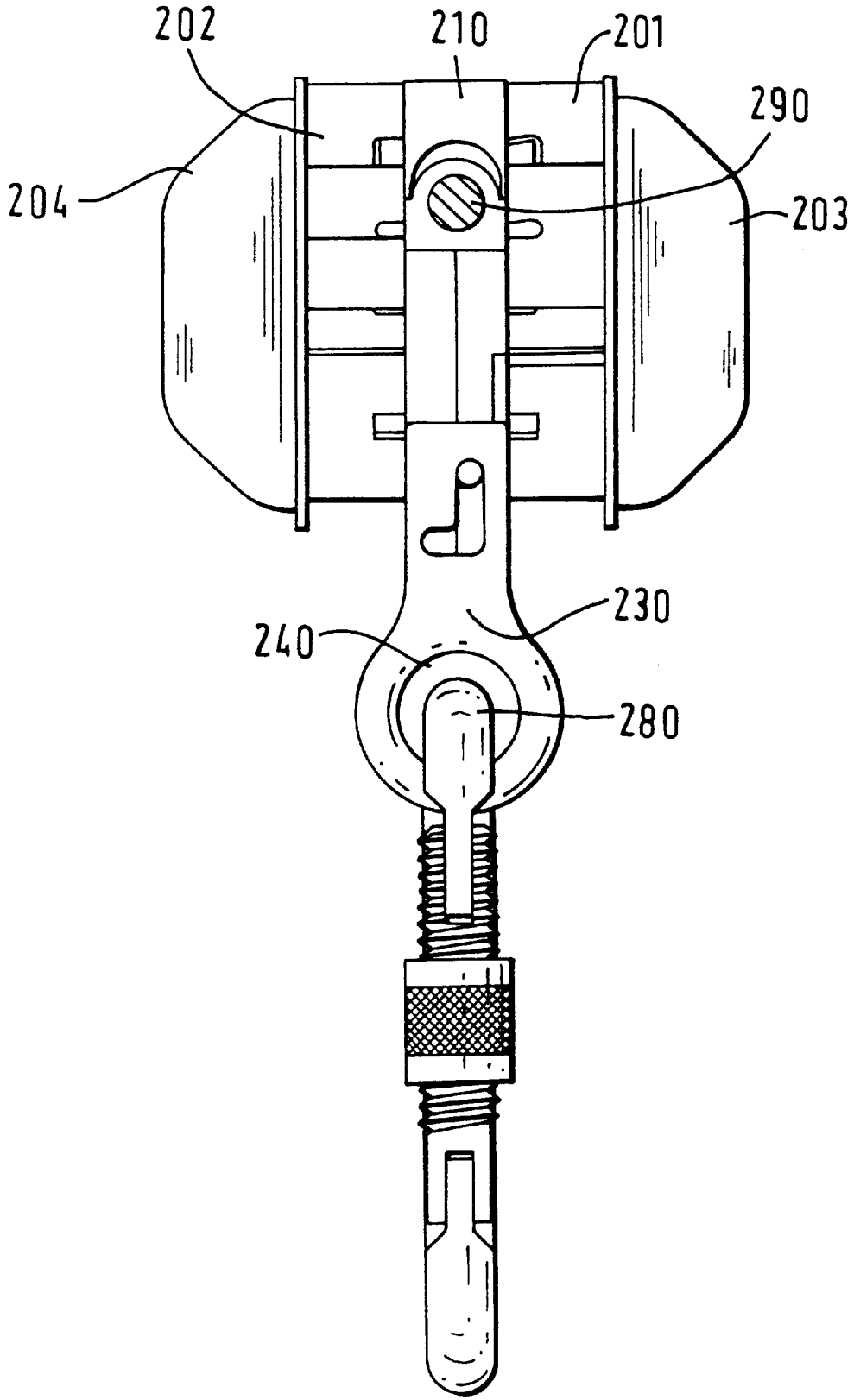
FIG. 7 is a view of the device of FIGS. 3–6, showing how attachment of a load prevents accidental removal from elongate support element.

Each of the separable chassis members 221, 222 and control catch 230 has a depending leg portion in which an attachment eye is formed. When the device is in the closed condition, as depicted in FIGS. 3, 5 and 7, the respective attachment eyes are arranged to align to form an aperture 240 adapted to receive an attachment for a load.

Figure 5:
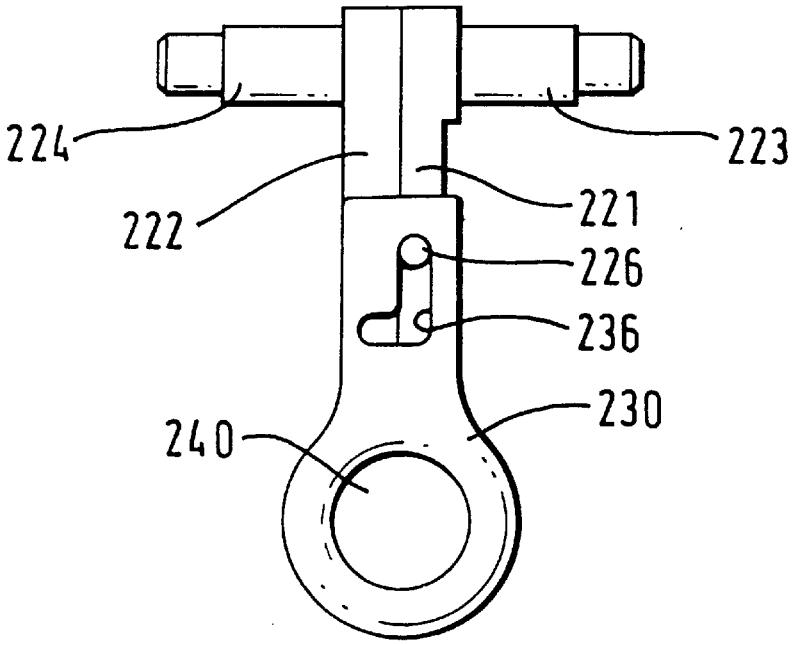
FIG. 5 is a view corresponding to FIG. 3, showing the device with slipper member, spaced-apart rotary members and covers omitted for clarity.

As seen with reference to FIG. 5, the separable chassis portions 221, 222 each have a spigot 223, 224 on which the respective starwheels 201, 202 are rotatably mounted.

Figure 4:
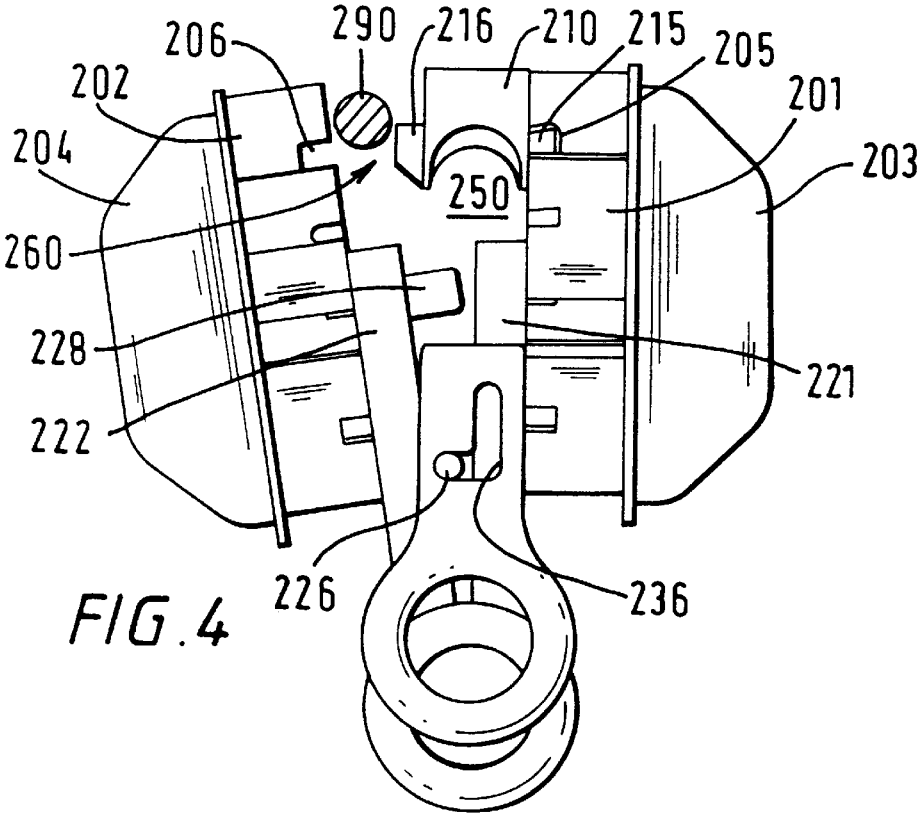
FIG. 4 is a view showing the device of FIG. 3 in the open condition.

Referring now to FIG. 4, the load attachment device of FIG. 3 is shown in the open condition. In this view, it can be seen that the lock pin 226 is located at the other end of the L-shaped slot 236 in the control catch 230. Separable chassis portion 222 has been pivoted out of engagement with separable chassis portion 221, carrying with it starwheel 202 and its respective cover 204. By virtue of the plane profiles of the groove 206 in starwheel 202 and of side projection 216 of slipper member 210, this pivotal movement causes separation of the starwheel 202 from the slipper member 210 and creates a gap 260 through which an elongate support element in the form of a length of cable 290 is able to pass. It will be noted that, in this open condition of the device, the aperture 240 is obscured by misalignment between the attachment eyes of the control catch 230 and those of the separable chassis portions 221, 222. It is therefore impossible for the device to be attached to or removed from cable 290 when a load is connected through aperture 240.

Figure 6:
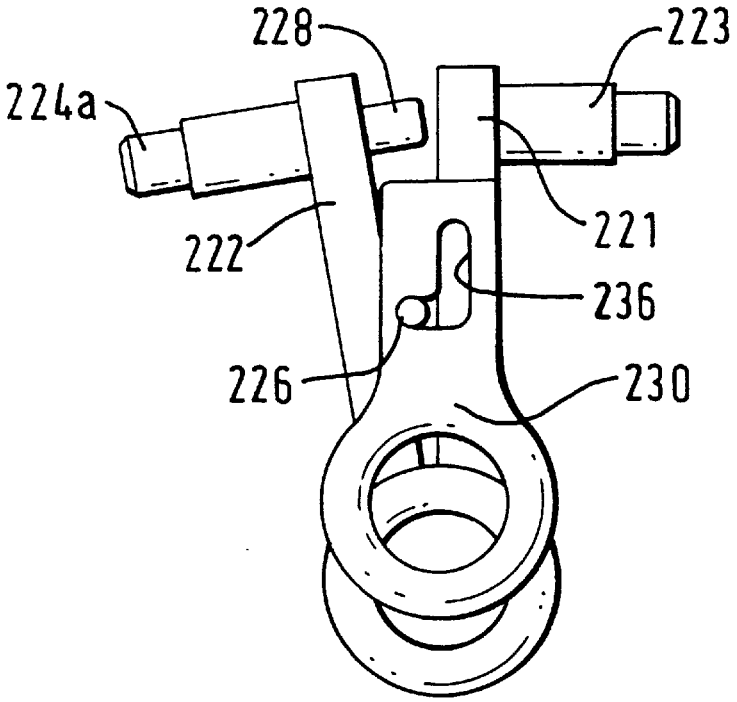
FIG. 6 is a view corresponding to FIG. 4, with the slipper member, spaced-apart rotary member and covers omitted for clarity.

FIG. 6 shows the separation of the separable chassis portions 221, 222 more clearly by omitting the detail of the slipper member 210, starwheels 201, 202 and their respective cover members 203, 204. Optionally, the separable chassis portion 222 has an alignment spigot 228 on the opposite side from the spindle 224*a* on which starwheel 202 is journalled. The alignment spigot 228 is receivable in a recess (not shown) in separable chassis portion 221 when the device is closed and helps to prevent cable 290 from entering between the separable chassis portions 221, 222 when the device is open.

Referring now to FIG. 7, this is a similar view to FIG. 3, but shows the device with a karabiner hook 280 connected through the aperture 240. In this condition, it is impossible to manipulate the control catch 230 in such a way that the device can be opened and cable 290 released. It is therefore essential for any load to be detached from the device before the device itself can be removed from the cable 290.

Figure 8:
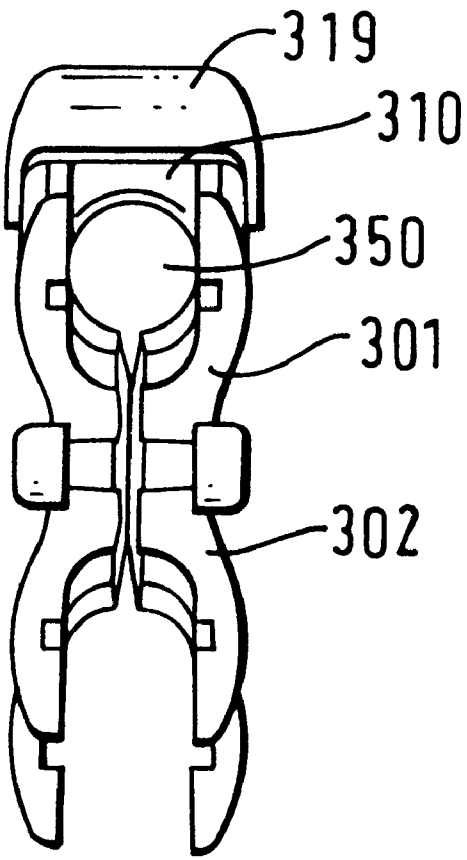
FIG. 8 is an end view of another embodiment of a device constructed in accordance with the invention.

Referring now to FIG. 8, a second embodiment of a removable load attachment device is shown. This device comprises a pair of starwheels 301, 302 with a slipper member 310 interposed between them. In the closed condition, as best seen in this Figure, the combination of starwheels 301, 302 and slipper member 310 define a space 350 in which an elongate support element (not shown) is receivable in use.

A resilient keep member 319 is fastened over the slipper member 310 and starwheels 301, 302 which serves to urge the slipper member/starwheel assembly to the closed condition.

Figure 9:
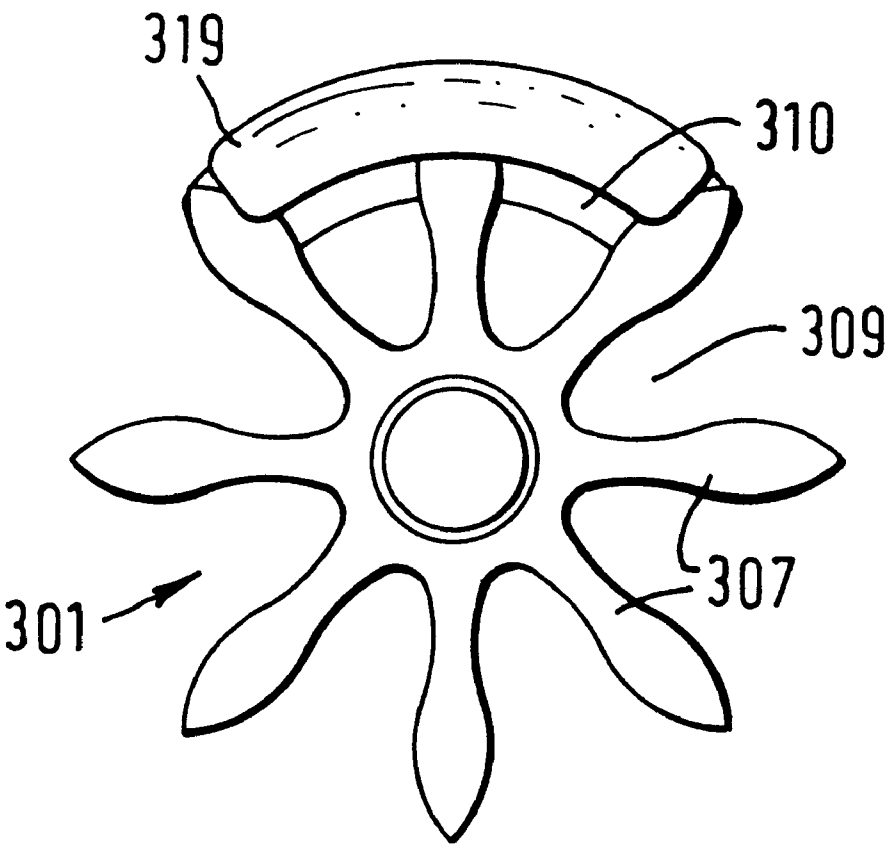
FIG. 9 is a side view of the device shown in FIG. 8.

FIG. 9 shows a side view of the device, from which it is easy to see why starwheels are so-named. In this view, only one starwheel 301 is visible and it is to be assumed that this is directly superimposed over its companion starwheel 302. However, it is to be noted that, in practice, the respective starwheels of a load attachment device constructed in accordance with the present invention are independently rotatable. The hub portion of starwheel 301 is provided with an aperture the function of which will be described in more detail below. The periphery of starwheel 301 has a plurality of petals 307 each separated by a recess 309. The function of such petals and recesses will also be described subsequently.

Figure 10:
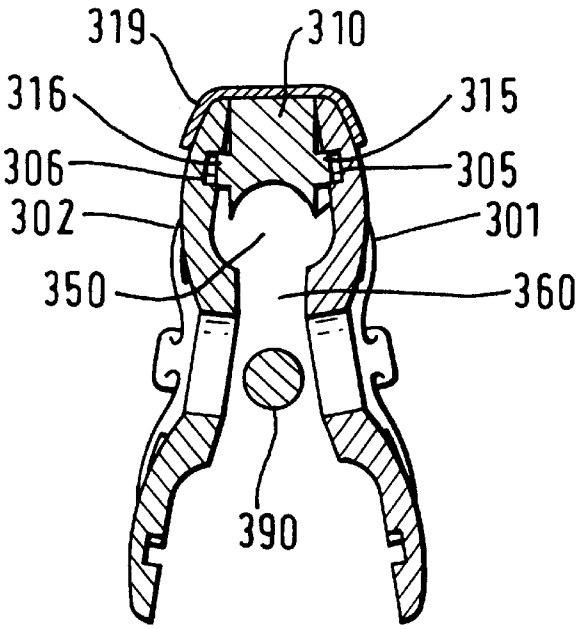
FIG. 10 is an end sectional view showing the device of FIGS. 8 and 9 in the open condition.
Figure 12D:
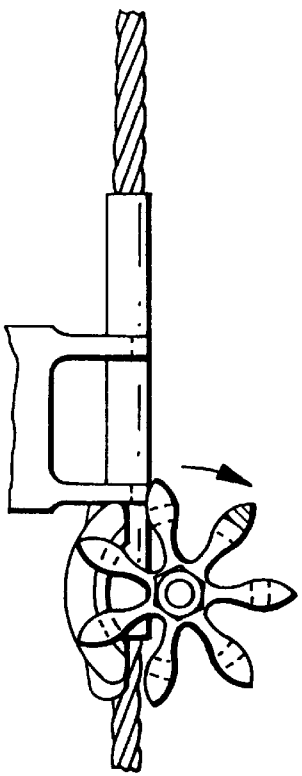
FIG. 12 shows, in stages, the passage of a device constructed in accordance with the present invention as it negotiates a typical elongate support element intermediate bracket.
Figure 12C:
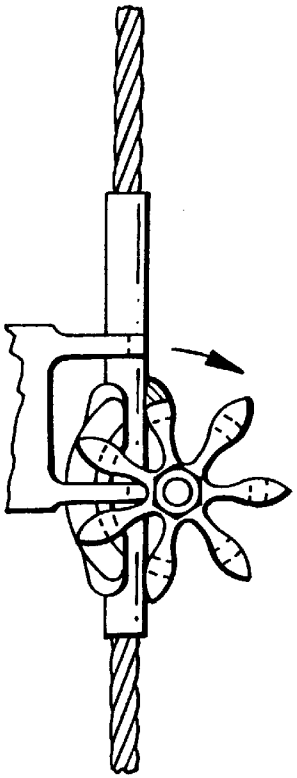
Figure 12B:
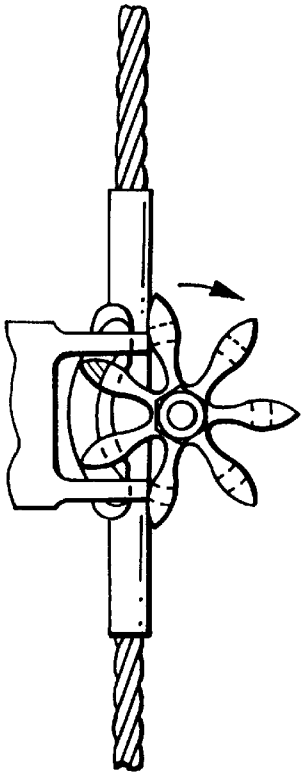
Figure 12A:
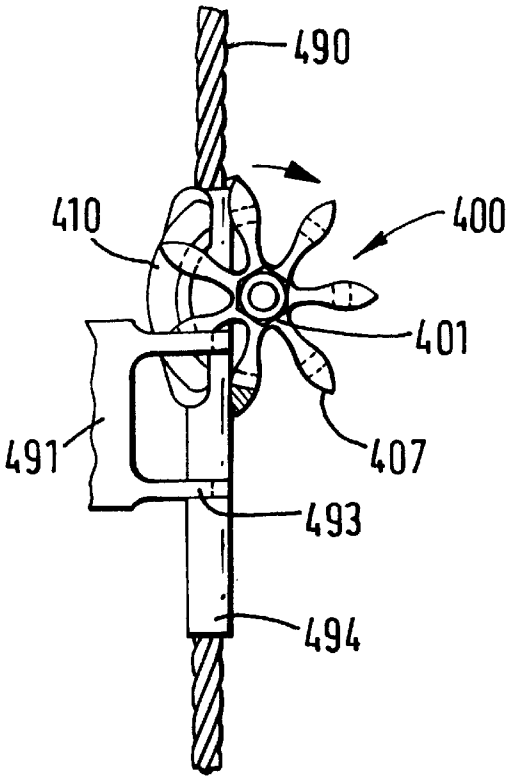

As best seen with reference to FIG. 10, which shows the device in the open condition, slipper member 310 is formed with a pair of side projections 315, 316 which are engaged in complementary grooves 305, 306 formed in the respective starwheels 301, 302. Each of the side projections and grooves has a plain profile to permit a degree of lateral separation between the engaging parts. Such lateral separation is important in allowing the device to be prised open against the biasing force of the keep member 319. Once opened, a gap 360 is created through which elongate support element in the form of a cable 390 is able to pass. After the cable 390 has been inserted into or removed from the space 350, the device is allowed to relax to the closed condition under the biasing force of the keep member 319.

Figure 11:
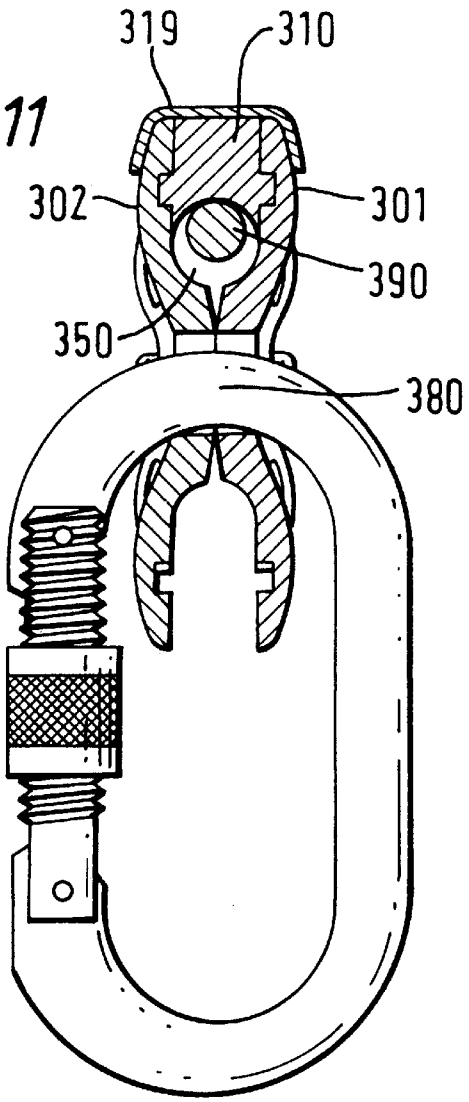
FIG. 11 is an end sectional view of the device of FIGS. 8 to 10, showing how it is locked in the closed condition by attachment of a kerabiner hook.

Referring now to FIG. 11, the device is shown locked onto cable 390 by the presence of a karabiner hook 380 threaded through the apertures at the hubs of the respective starwheels 301, 302. In this condition, it is impossible to manipulate the starwheels in such a way that the device can be opened to release the cable 390 because the exit passageway is blocked by the karabiner hook 380. It is therefore essential for any load to be detached from the device before the device itself can be removed from the cable 390.

In yet another embodiment (not illustrated) having a similar working principle to the embodiment depicted in FIGS. 8 to 10, the starwheels may be mounted on separable chassis elements which have depending attachment eyes. In this construction, the karabiner hook is not threaded through apertures provided at the starwheel hubs, but is threaded through the attachment eyes instead. The same barrier to separation of the starwheels is therefore present whenever a load is attached.

The function of the starwheel petals and their associated recesses will now be described with reference to FIG. 12, which shows the sequence of operations undertaken by the device whenever it traverses an intermediate bracket for the elongate support element.

View 12(*a*) shows stage 1 in which the device 400 passes along elongate support element 490 in the form of a cable and partially entraps the guide tube 494 of a cable support bracket 491. In this view, the slipper member 410 passes behind the bracket legs 493 and does not foul on them. These legs 493 may be any shape in cross-section and not necessarily square as shown in the Figure. Starwheel 401, which lies in a similar plane to the curved bracket legs 493, offers a gap or recess between two adjacent petals 407. Should the situation arise where a recess is not in register with the bracket legs 493, contact between a petal tip and the legs 493 causes the starwheel 401 to rotate slightly and thereby bring a recess into alignment with the leg. Similar principles apply in relation to the second starwheel which is omitted from this Figure for clarity.

In the presently-described sequence, since the motion of the device 400 is in the sense of down the page, the bracket leg 493 abuts against the approaching petal and rotates it clockwise. In so doing, the device 400 moves to the position shown in view 12(*b*). The condition represented by view 12(*c*) is similar to that shown in view 12(*a*) in that the device is shown traversing the second leg 493 of the cable intermediate bracket 491. Ultimately, the device passes beyond the bracket 491 as shown in view 12(*d*). It is to be noted that the direction of the turning force is always correct for either direction of travel of the device.

The turning force on the starwheels is opposed by frictional forces occurring between the starwheels and their respective axles and also by frictional forces arising from relative movement between the starwheels and the slipper member 410. Such frictional forces may be reduced by the application of low friction coatings or other bearing technology.

Although the invention has been particularly described with reference to embodiments employing so-called starwheels, it will be understood by persons skilled in the art that this is non-limitative and that other forms of spaced-apart rotary member can be used. Various other modifications may also be apparent to skilled persons without departing from the scope of the claims which follow.

What is claimed is:

1. A load transfer device comprising:

(a) first and second spaced-apart rotary members sharing a common axis of rotation, each of said spaced-apart rotary members having at least one recess formed in its periphery;

(b) a slipper member extending between the spaced-apart rotary members and defining therewith a space adapted to receive an elongate support element in an orientation substantially perpendicular to said common axis of rotation, along which the device travels in use, said slipper member being positively engaged with the spaced-apart rotary members;

(c) first and second spaced-apart body members, each of said first and second spaced apart body members having a respective one of said first and second spaced-apart rotary members rotatably mounted thereon;

(d) a passage provided between the first and second spaced apart body members, said passage being narrower than the width of said elongate support element; and (e) load attachment means for attaching a load to the device, said load attachment means comprising a connecting eye provided on a portion of each of said first and second spaced-apart body members, the respective connecting eyes being adapted to be in alignment during operation of the device, such that said spaced-apart rotary members are rotatably mounted in relation to the slipper member and said recesses are adapted to traverse support means used to support said elongate support element without user intervention by rotation of the spaced-apart rotary members relative to the slipper member whereby elements of said support means are successively received, guided and passed by the recesses automatically;

characterized in that said first and second spaced-apart body members are transversely moveable in relation to each other such that, when they are moved out of alignment with each other, access means is formed permitting said elongate support element to be introduced into or removed from said space by means of said passage to enable the device to be attached to or detached from the elongate element.

2. A load transfer device as claimed in claim 1 wherein the relative transverse movement between the first and second spaced-apart body members is along an arcuate path.

3. A load transfer device as claimed in claim 1 wherein the spaced-apart rotary members are positively engaged with the slipper member in a manner which defines an elongate support element-receiving passageway between said spaced-apart rotary members.

4. A load transfer device as claimed in claim 3 wherein a groove dimensioned to accommodate the elongate support element is provided, said groove being obscured when the first and second spaced-apart body members are in alignment, thereby preventing accidental insertion and/or removal of the elongate support element.

5. A load transfer device as claimed in claim 4 wherein the groove forms part of the load attachment means.

6. A load transfer device as claimed in claim 1 wherein the spaced-apart rotary members are in the form of wheels having a plurality of petals projecting radially from their hubs, said petals defining, between adjacent pairs thereof, recesses adapted to traverse intermediate brackets for the elongate support element without user intervention.

7. A load transfer device as claimed in claim 1 wherein engagement of a load with the load attachment means is effective to lock the device against accidental removal from the elongate support element.

8. A load transfer device comprising:

(a) first and second spaced-apart rotary members sharing a common axis of rotation, each of said spaced-apart rotary members having at least one recess formed in its periphery;

(b) a slipper member extending between the spaced-apart rotary members and defining therewith a space adapted to receive an elongate support element in an orientation substantially perpendicular to said common axis of rotation, along which the device travels in use, said slipper member being positively engaged with the spaced-apart rotary members;

(c) first and second chassis members, each of said first and second chassis members having a respective one of said first and second spaced-apart rotary members rotatably mounted thereon;

(d) load attachment means for attaching a load to the device, said load attachment means comprising a connecting eye provided on a portion of each of said first and second chassis members, the respective connecting eyes being adapted to be in alignment during operation of the device;

(e) means for separating said first and second chassis members thereby to form a passage between one of said first and second spaced-apart rotary members and said slipper member, said passage permitting said elongate support element to be introduced into or removed from said space to enable the device to be attached to or detached from the elongate element; and (f) means for preventing separation of said first and second chassis members when a load is attached, such that said spaced-apart rotary members are rotatably mounted in relation to the slipper member and said recesses are adapted to traverse support means used to support said elongate support element without user intervention by rotation of the spaced-apart rotary members relative to the slipper member whereby elements of said support means are successively received, guided and passed by the recesses automatically.

9. A load transfer device as claimed in claim 8 wherein the spaced-apart rotary members are journalled on individual bosses carried by the separable chassis parts, such that, when the separable parts of-the chassis are disengaged, the access means is open and, when the separable parts of the chassis are engaged, the access means is closed.

10. A load transfer device as claimed in claim 8 wherein the spaced-apart rotary members are positively engaged with the slipper member in a manner which defines an elongate support element-receiving passageway between said spaced-apart rotary members.

11. A load transfer device as claimed in claim 8 wherein the spaced-apart rotary members are in the form of wheels having a plurality of petals projecting radially from their hubs, said petals defining, between adjacent pairs thereof, recesses adapted to traverse intermediate brackets for the elongate support element without user intervention.

12. A load transfer device as claimed in claim 8 wherein engagement of a load with the load attachment means is effective to lock the device against accidental removal from the elongate support element.

13. A load transfer device comprising:

(a) first and second spaced-apart rotary members sharing a common axis of rotation, each of said spaced-apart rotary members having at least one recess formed in its periphery;

(b) a slipper member extending between the spaced-apart rotary members and defining therewith a space adapted to receive an elongate support element in an orientation substantially perpendicular to said common axis of rotation, along which the device travels in use, said slipper member being positively engaged with the spaced-apart rotary members in a manner which allows the spaced-apart rotary members to be pried apart a sufficient distance to permit insertion or withdrawal of the elongate support element, said slipper member further being combined with a resilient keep member which exerts a biasing force opposing the action of prying apart of the spaced-apart rotary members; and (c) load attachment means for attaching a load to the device, such that the spaced-apart rotary members are rotatably mounted in relation to the slipper member and said recesses are adapted to traverse support means used to support said elongate support element without user intervention by rotation of the spaced-apart rotary members relative to the slipper member such that elements of said support means are successively received, guided and passed by the recesses automatically;

characterized in that access means are provided between the spaced-apart rotary members to enable said elongate support element to be introduced into or removed from said space in an orientation substantially perpendicular to the common axis of rotation of the spaced-apart rotary members so as to allow the device to be attached to or detached from the elongate support element.

14. A load transfer device as claimed in claim 13 wherein the spaced-apart rotary members are positively engaged with the slipper member in a manner which defines an elongate support element-receiving passageway between said spaced-apart rotary members.

15. A load transfer device as claimed in claim 13 wherein the spaced-apart rotary members are in the form of wheels having a plurality of petals projecting radially from their hubs, said petals defining, between adjacent pairs thereof, recesses adapted to traverse intermediate brackets for the elongate support element without user intervention.

16. A load transfer device as claimed in claim 13 wherein engagement of a load with the load attachment means is effective to lock the device against accidental removal from the elongate support element.

* * * * *